US008577676B2

(12) United States Patent
Muesch

(10) Patent No.: US 8,577,676 B2
(45) Date of Patent: Nov. 5, 2013

(54) METHOD AND APPARATUS FOR MAINTAINING SPEECH AUDIBILITY IN MULTI-CHANNEL AUDIO WITH MINIMAL IMPACT ON SURROUND EXPERIENCE

(75) Inventor: Hannes Muesch, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 232 days.

(21) Appl. No.: 12/988,118

(22) PCT Filed: Apr. 17, 2009

(86) PCT No.: PCT/US2009/040900

§ 371 (c)(1),
(2), (4) Date: Oct. 15, 2010

(87) PCT Pub. No.: WO2010/011377

PCT Pub. Date: Jan. 28, 2010

(65) Prior Publication Data

US 2011/0054887 A1 Mar. 3, 2011

Related U.S. Application Data

(60) Provisional application No. 61/046,271, filed on Apr. 18, 2008.

(51) Int. Cl.
*G10L 21/00* (2013.01)

(52) U.S. Cl.
USPC ..... 704/225; 704/226

(58) Field of Classification Search
USPC ..... 704/225
See application file for complete search history.

(56) References Cited

U.S. PATENT DOCUMENTS 5,046,097 A 9/1991 Lowe
5,105,462 A 4/1992 Lowe (Continued)

FOREIGN PATENT DOCUMENTS

CN 101151659 3/2008
EP 0517233 12/1992

(Continued)

OTHER PUBLICATIONS

Shirley, et al., "Measurement of speech intelligibility in noise: A comparison of a stereo image source and a central loudspeaker source", Audio Engineering Society, Convention Paper 6372, presented at the 118th Convention, May 28-31, 2005 in Barcelona, Spain, pp. 1-6.

(Continued)

*Primary Examiner* — Jialong He
*Assistant Examiner* — Jie Shan

(57) ABSTRACT

In one embodiment the present invention includes a method of improving audibility of speech in a multi-channel audio signal. The method includes comparing a first characteristic and a second characteristic of the multi-channel audio signal to generate an attenuation factor. The first characteristic corresponds to a first channel of the multi-channel audio signal that contains speech and non-speech audio, and the second characteristic corresponds to a second channel of the multi-channel audio signal that contains predominantly non-speech audio. The method further includes adjusting the attenuation factor according to a speech likelihood value to generate an adjusted attenuation factor. The method further includes attenuating the second channel using the adjusted attenuation factor.

23 Claims, 5 Drawing Sheets

(56) References Cited

U.S. PATENT DOCUMENTS

| | | | | |
|---|---|---|---|---|
| 5,208,860 | A | 5/1993 | Lowe | |
| 5,212,733 | A | 5/1993 | DeVitt | |
| 5,375,188 | A | 12/1994 | Serikawa | |
| 5,956,674 | A * | 9/1999 | Smyth et al. | 704/200.1 |
| 6,311,155 | B1 | 10/2001 | Vaudrey | |
| 6,442,278 | B1 | 8/2002 | Vaudrey | |
| 6,487,535 | B1 * | 11/2002 | Smyth et al. | 704/500 |
| 6,650,755 | B2 * | 11/2003 | Vaudrey et al. | 381/18 |
| 6,697,491 | B1 | 2/2004 | Griesinger | |
| 6,772,127 | B2 | 8/2004 | Saunders | |
| 6,912,501 | B2 | 6/2005 | Vaudrey | |
| 6,914,988 | B2 * | 7/2005 | Irwan et al. | 381/22 |
| 7,050,966 | B2 * | 5/2006 | Schneider et al. | 704/200.1 |
| 7,076,071 | B2 | 7/2006 | Katz | |
| 7,107,211 | B2 | 9/2006 | Griesinger | |
| 7,251,337 | B2 * | 7/2007 | Jacobs | 381/107 |
| 7,260,231 | B1 | 8/2007 | Wedge | |
| 7,261,182 | B2 * | 8/2007 | Zainea | 181/293 |
| 7,266,501 | B2 | 9/2007 | Saunders | |
| 7,376,558 | B2 * | 5/2008 | Gemello et al. | 704/226 |
| 7,551,745 | B2 | 6/2009 | Gundry | |
| 8,144,881 | B2 * | 3/2012 | Crockett et al. | 381/56 |
| 8,194,889 | B2 * | 6/2012 | Seefeldt | 381/107 |
| 8,199,933 | B2 * | 6/2012 | Seefeldt | 381/104 |
| 2002/0013698 | A1 | 1/2002 | Vaudrey | |
| 2003/0002683 | A1 * | 1/2003 | Vaudrey et al. | 381/27 |
| 2003/0044032 | A1 | 3/2003 | Irwan | |
| 2003/0112088 | A1 * | 6/2003 | Bizjak | 333/14 |
| 2004/0042626 | A1 | 3/2004 | Balan | |
| 2004/0213420 | A1 * | 10/2004 | Gundry et al. | 381/104 |
| 2005/0071028 | A1 | 3/2005 | Yuen | |
| 2005/0117762 | A1 | 6/2005 | Sakurai | |
| 2005/0232445 | A1 | 10/2005 | Vaudrey | |
| 2007/0027682 | A1 | 2/2007 | Bennett | |
| 2007/0076902 | A1 | 4/2007 | Master | |
| 2010/0121634 | A1 * | 5/2010 | Muesch | 704/224 |
| 2011/0054887 | A1 * | 3/2011 | Muesch | 704/225 |
| 2011/0150233 | A1 * | 6/2011 | Gautama | 381/71.6 |

FOREIGN PATENT DOCUMENTS

| | | |
|---|---|---|
| EP | 0637011 | 2/1995 |
| EP | 0645756 | 3/1995 |
| JP | 2003-084790 | 9/2003 |
| JP | 2006-072130 | 3/2006 |
| RU | 2163032 | 2/2001 |
| WO | 9912386 | 3/1999 |
| WO | 03022003 | 3/2003 |
| WO | 03028407 | 4/2003 |
| WO | 2007/120453 | 10/2007 |
| WO | 2008/032209 | 3/2008 |
| WO | 2008031611 | 3/2008 |

OTHER PUBLICATIONS

Vinton, et al., "Automated Speech/Other Discrimination for Loudness Monitoring", Audio Engineering Society, Convention Paper 6437, presented at the 118th Convention, May 28-31, 2005 in Barcelona, Spain; pp. 1-11.

Goodwin, et al., "A Dynamic Programming Approach to Audio Segmentation and Speech/Music Discrimination", International Conference on Acoustics on May 17-21, 2004, Fairmont Queen Elizabeth Hotel, Montreal, Quebec, Canada; vol. 4 of 5, pp. IV-309-IV-312.

Avendano, et al., "Ambience Extraction and Synthesis From Stereo Signals for Multi-Channel Audio Up-Mix", Acoustics, Speech, and Signal Processing, 2002, vol. 2, pp. 1957-1960.

Pollack, et al., "Stereophonic Listening and Speech Intelligibility againstVoice Babble", The Journal of the Acoustical Society of America, vol. 30, No. 2, Feb. 1958, pp. 131-133.

* cited by examiner

METHOD AND APPARATUS FOR MAINTAINING SPEECH AUDIBILITY IN MULTI-CHANNEL AUDIO WITH MINIMAL IMPACT ON SURROUND EXPERIENCE

CROSS REFERENCE TO RELATED APPLICATIONS

This application claims the benefit of priority of U.S. Provisional Patent Application No. 61/046,271, filed Apr. 18, 2008, hereby incorporated by reference in its entirety.

BACKGROUND

The invention relates to audio signal processing in general and to improving clarity of dialog and narrative in surround entertainment audio in particular.

Unless otherwise indicated herein, the approaches described in this section are not prior art to the claims in this application and are not admitted to be prior art by inclusion in this section.

Modern entertainment audio with multiple, simultaneous channels of audio (surround sound) provides audiences with immersive, realistic sound environments of immense entertainment value. In such environments many sound elements such as dialog, music, and effects are presented simultaneously and compete for the listener's attention. For some members of the audience—especially those with diminished auditory sensory abilities or slowed cognitive processing—dialog and narrative may be hard to understand during parts of the program where loud competing sound elements are present. During those passages these listeners would benefit if the level of the competing sounds were lowered.

The recognition that music and effects can overpower dialog is not new and several methods to remedy the situation have been suggested. However, as will be outlined next, the suggested methods are either incompatible with current broadcast practice, exert an unnecessarily high toll on the overall entertainment experience, or do both.

It is a commonly adhered-to convention in the production of surround audio for film and television to place the majority of dialog and narrative into only one channel (the center channel, also referred to as the speech channel). Music, ambiance sounds, and sound effects are typically mixed into both the speech channel and all remaining channels (e.g., Left [L], Right [R], Left Surround [ls] and Right Surround [rs], also referred to as the non-speech channels). As a result, the speech channel carries the majority of speech and a significant amount of the non-speech audio contained in the audio program, whereas the non-speech channels carry predominantly non-speech audio, but may also carry a small amount of speech. One simple approach to aiding the perception of dialog and narrative in these conventional mixes is to permanently reduce the level of all non-speech channels relative to the level of the speech channel, for example by 6 dB. This approach is simple and effective and is practiced today (e.g., SRS [Sound Retrieval System] Dialog Clarity or modified downmix equations in surround decoders). However, it suffers from at least one drawback: the constant attenuation of the non-speech channels may lower the level of quiet ambiance sounds that do not interfere with speech reception to the point where they can no longer be heard. By attenuating non-interfering ambiance sounds the aesthetic balance of the program is altered without any attendant benefit for speech understanding.

An alternative solution is described in a series of patents (U.S. Pat. No. 7,266,501, U.S. Pat. No. 6,772,127, U.S. Pat. No. 6,912,501, and U.S. Pat. No. 6,650,755) by Vaudrey and Saunders. As understood, their approach involves modifying the content production and distribution. According to that arrangement, the consumer receives two separate audio signals. The first of these signals comprises the "Primary Content" audio. In many cases this signal will be dominated by speech but, if the content producer desires, may contain other signal types as well. The second signal comprises the "Secondary Content" audio, which is composed of all the remaining sounds elements. The user is given control over the relative levels of these two signals, either by manually adjusting the level of each signal or by automatically maintaining a user-selected power ratio. Although this arrangement can limit the unnecessary attenuation of non-interfering ambiance sounds, its widespread deployment is hindered by its incompatibility with established production and distribution methods.

Another example of a method to manage the relative levels of speech and non-speech audio has been proposed by Bennett in U.S. Application Publication No. 20070027682.

All the examples of the background art share the limitation of not providing any means for minimizing the effect the dialog enhancement has on the listening experience intended by the content creator, among other deficiencies. It is therefore the object of the present invention to provide a means of limiting the level of non-speech audio channels in a conventionally mixed multi-channel entertainment program so that speech remains comprehensible while also maintaining the audibility of the non-speech audio components.

Thus, there is a need for improved ways of maintaining speech audibility. The present invention solves these and other problems by providing an apparatus and method of improving speech audibility in a multi-channel audio signal.

SUMMARY

Embodiments of the present invention improve speech audibility. In one embodiment the present invention includes a method of improving audibility of speech in a multi-channel audio signal. The method includes comparing a first characteristic and a second characteristic of the multi-channel audio signal to generate an attenuation factor. The first characteristic corresponds to a first channel of the multi-channel audio signal that contains speech and non-speech audio, and the second characteristic corresponds to a second channel of the multi-channel audio signal that contains predominantly non-speech audio. The method further includes adjusting the attenuation factor according to a speech likelihood value to generate an adjusted attenuation factor. The method further includes attenuating the second channel using the adjusted attenuation factor.

A first aspect of the invention is based on the observation that the speech channel of a typical entertainment program carries a non-speech signal for a substantial portion of the program duration. Consequently, according to this first aspect of the invention, masking of speech audio by non-speech audio may be controlled by (a) determining the attenuation of a signal in a non-speech channel necessary to limit the ratio of the signal power in the non-speech channel to the signal power in the speech channel not to exceed a predetermined threshold and (b) scaling the attenuation by a factor that is monotonically related to the likelihood of the signal in the speech channel being speech, and (c) applying the scaled attenuation.

A second aspect of the invention is based on the observation that the ratio between the power of the speech signal and the power of the masking signal is a poor predictor of speech intelligibility. Consequently, according to this second aspect of the invention, the attenuation of the signal in the non-speech channel that is necessary to maintain a predetermined level of intelligibility is calculated by predicting the intelligibility of the speech signal in the presence of the non-speech signals with a psycho-acoustically based intelligibility prediction model.

A third aspect of the invention is based on the observations that, if attenuation is allowed to vary across frequency, (a) a given level of intelligibility can be achieved with a variety of attenuation patterns, and (b) different attenuation patterns can yield different levels of loudness or salience of the non-speech audio. Consequently, according to this third aspect of the invention, masking of speech audio by non-speech audio is controlled by finding the attenuation pattern that maximizes loudness or some other measure of salience of the non-speech audio under the constraint that a predetermined level of predicted speech intelligibility is achieved.

The embodiments of the present invention may be performed as a method or process. The methods may be implemented by electronic circuitry, as hardware or software or a combination thereof. The circuitry used to implement the process may be dedicated circuitry (that performs only a specific task) or general circuitry (that is programmed to perform one or more specific tasks).

The following detailed description and accompanying drawings provide a better understanding of the nature and advantages of the present invention.

DETAILED DESCRIPTION

Described herein are techniques for maintaining speech audibility. In the following description, for purposes of explanation, numerous examples and specific details are set forth in order to provide a thorough understanding of the present invention. It will be evident, however, to one skilled in the art that the present invention as defined by the claims may include some or all of the features in these examples alone or in combination with other features described below, and may further include modifications and equivalents of the features and concepts described herein.

Various method and processes are described below. That they are described in a certain order is mainly for ease of presentation. It is to be understood that particular steps may be performed in other orders or in parallel as desired according to various implementations. When a particular step must precede or follow another, such will be pointed out specifically when not evident from the context.

Figure 1:
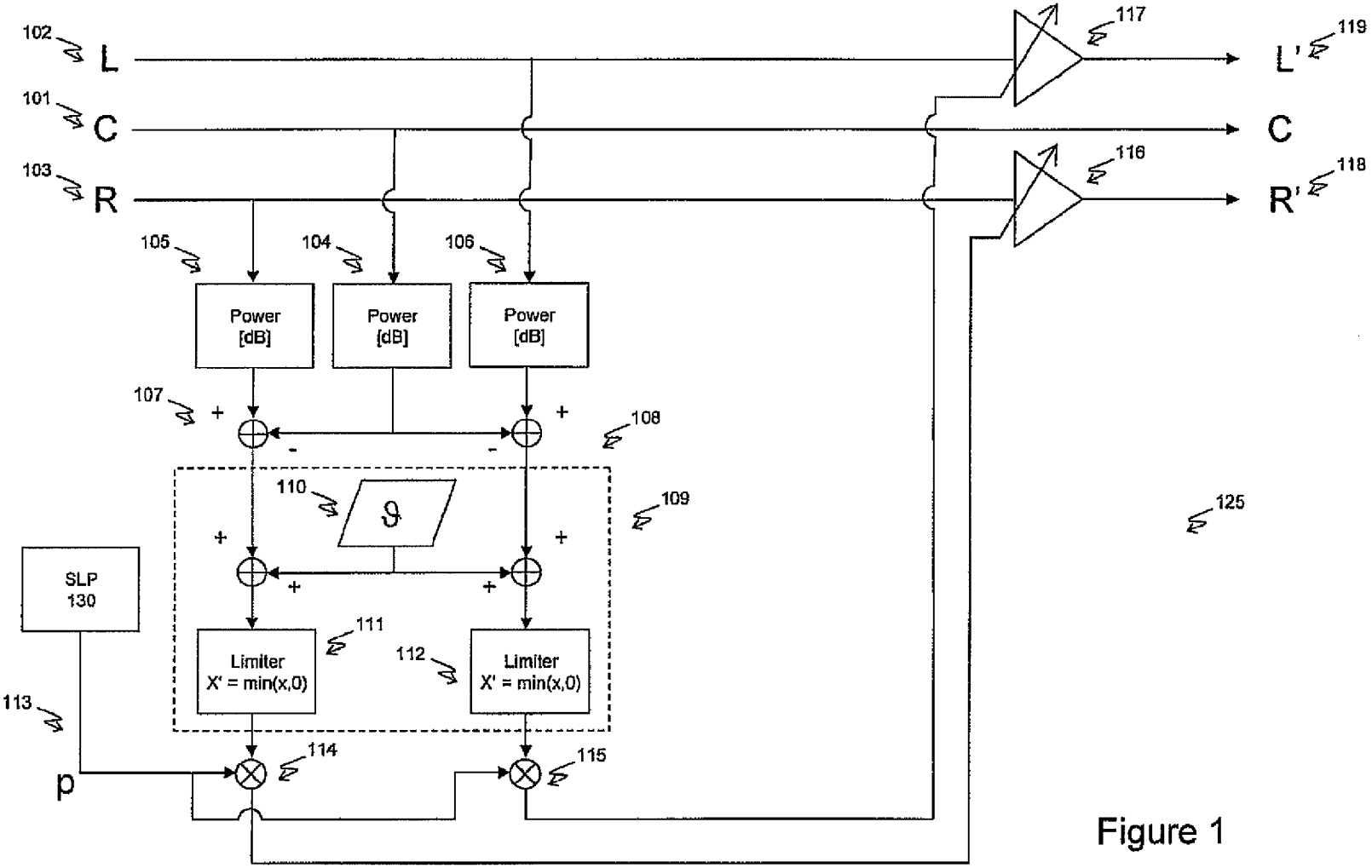
FIG. 1 illustrates a signal processor according to one embodiment of the present invention.

The principle of the first aspect of the invention is illustrated in FIG. 1. Referring now to FIG. 1, a multi-channel signal consisting of a speech channel (101) and two non-speech channels (102 and 103) is received. The power of the signals in each of these channels is measured with a bank of power estimators (104, 105, and 106) and expressed on a logarithmic scale [dB]. These power estimators may contain a smoothing mechanism, such as a leaky integrator, so that the measured power level reflects the power level averaged over the duration of a sentence or an entire passage. The power level of the signal in the speech channel is subtracted from the power level in each of the non-speech channels (by adders 107 and 108) to give a measure of the power level difference between the two signal types. Comparison circuit 109 determines for each non-speech channel the number of dB by which the non-speech channel must be attenuated in order for its power level to remain at least Θ dB below the power level of the signal in the speech channel. (The symbol "Θ" denotes a variable and may also be referred to as script theta.) According to one embodiment, one implementation of this is to add the threshold value Θ (stored by the circuit 110) to the power level difference (this intermediate result is referred to as the margin) and limit the result to be equal to or less than zero (by limiters 111 and 112). The result is the gain (or negated attenuation) in dB that must be applied to the non-speech channels to keep their power level Θ dB below the power level of the speech channel. A suitable value for Θ is 15 dB. The value of Θ may be adjusted as desired in other embodiments.

Because there is a unique relation between a measure expressed on a logarithmic scale (dB) and that same measure expressed on a linear scale, a circuit that is equivalent to FIG. 1 can be built where power, gain, and threshold all are expressed on a linear scale. In that implementation all level differences are replaced by ratios of the linear measures. Alternative implementations may replace the power measure with measures that are related to signal strength, such as the absolute value of the signal.

One noteworthy feature of the first aspect of the invention is to scale the gain thus derived by a value monotonically related to the likelihood of the signal in the speech channel in fact being speech. Still referring to FIG. 1, a control signal (113) is received and multiplied with the gains (by multipliers 114 and 115). The scaled gains are then applied to the corresponding non-speech channels (by amplifiers 116 and 117) to yield the modified signals L' and R' (118 and 119). The control signal (113) will typically be an automatically derived measure of the likelihood of the signal in the speech channel being speech. Various methods of automatically determining the likelihood of a signal being a speech signal may be used. According to one embodiment, a speech likelihood processor 130 generates the speech likelihood value p (113) from the information in the C channel 101. One example of such a mechanism is described by Robinson and Vinton in "Automated Speech/Other Discrimination for Loudness Monitoring" (Audio Engineering Society, Preprint number 6437 of Convention 118, May 2005). Alternatively, the control signal (113) may be created manually, for example by the content creator and transmitted alongside the audio signal to the end user.

Those skilled in the art will easily recognize how the arrangement can be extended to any number of input channels.

Figure 2:
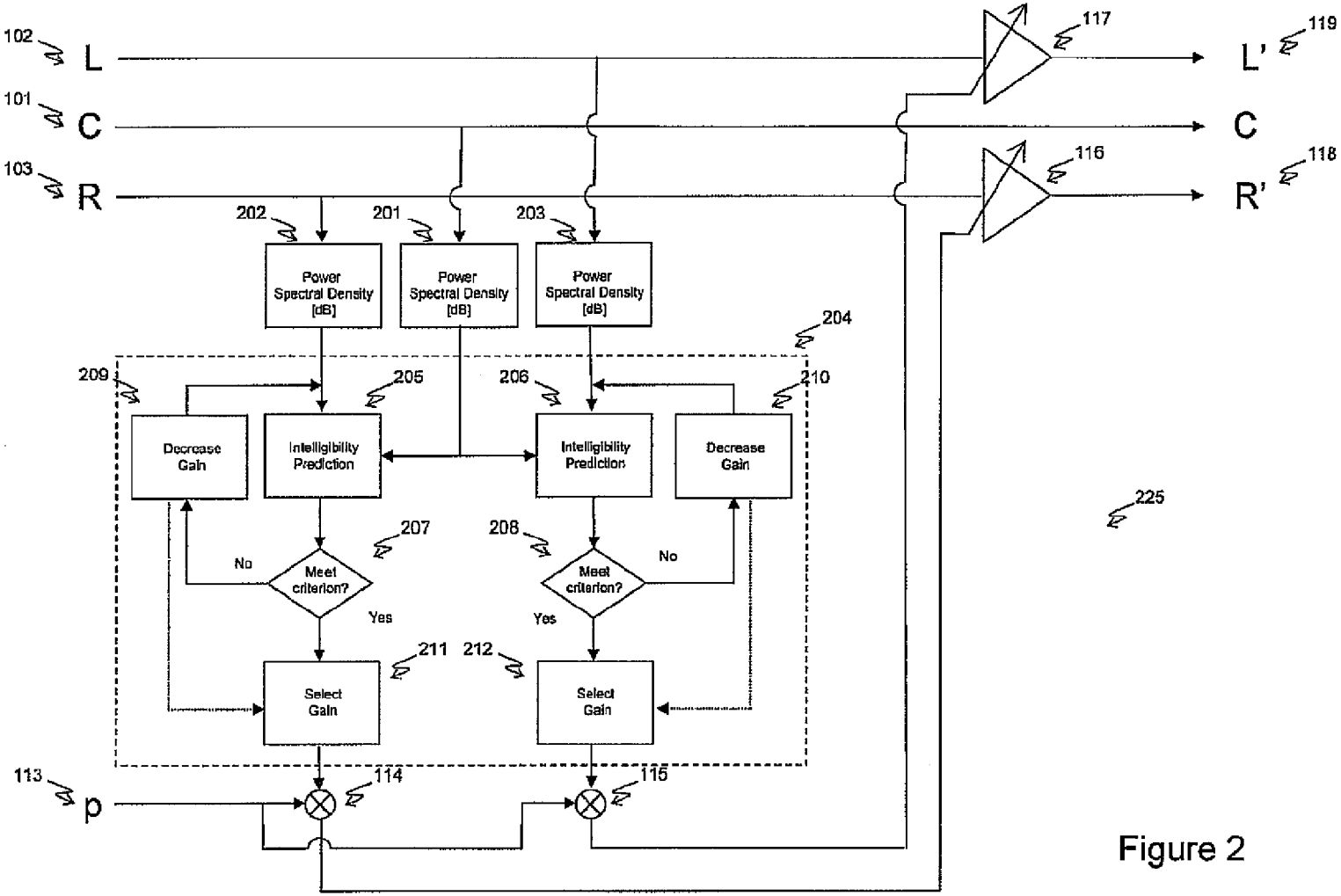
FIG. 2 illustrates a signal processor according to another embodiment of the present invention.

The principle of the second aspect of the invention is illustrated in FIG. 2. Referring now to FIG. 2, a multi-channel signal consisting of a speech channel (101) and two non-speech channels (102 and 103) is received. The power of the signals in each of these channels is measured with a bank of power estimators (201, 202, and 203). Unlike their counterparts in FIG. 1, these power estimators measure the distribution of the signal power across frequency, resulting in a power spectrum rather than a single number. The spectral resolution of the power spectrum ideally matches the spectral resolution of the intelligibility prediction model (205 and 206, not yet discussed).

The power spectra are fed into comparison circuit 204. The purpose of this block is to determine the attenuation to be applied to each non-speech channel to ensure that the signal in the non-speech channel does not reduce the intelligibility of the signal in the speech channel to be less than a predetermined criterion. This functionality is achieved by employing an intelligibility prediction circuit (205 and 206) that predicts speech intelligibility from the power spectra of the speech signal (201) and non-speech signals (202 and 203). The intelligibility prediction circuits 205 and 206 may implement a suitable intelligibility prediction model according to design choices and tradeoffs. Examples are the Speech Intelligibility Index as specified in ANSI S3.5-1997 ("Methods for Calculation of the Speech Intelligibility Index") and the Speech Recognition Sensitivity model of Muesch and Buus ("Using statistical decision theory to predict speech intelligibility. I. Model structure" Journal of the Acoustical Society of America, 2001, Vol 109, p 2896-2909). It is clear that the output of the intelligibility prediction model has no meaning when the signal in the speech channel is something other than speech. Despite this, in what follows the output of the intelligibility prediction model will be referred to as the predicted speech intelligibility. The perceived mistake will be accounted for in subsequent processing by scaling the gain values output from the comparison circuit 204 with a parameter that is related to the likelihood of the signal being speech (113, not yet discussed).

The intelligibility prediction models have in common that they predict either increased or unchanged speech intelligibility as the result of lowering the level of the non-speech signal. Continuing on in the process flow of FIG. 2, the comparison circuits 207 and 208 compare the predicted intelligibility with a criterion value. If the level of the non-speech signal is low so that the predicted intelligibility exceeds the criterion, the gain parameter, which is initialized to 0 dB, is retrieved from circuit 209 or 210 and provided to the circuits 211 and 212 as the output of comparison circuit 204. If the criterion is not met, the gain parameter is decreased by a fixed amount and the intelligibility prediction is repeated. A suitable step size for decreasing the gain is 1 dB. The iteration as just described continues until the predicted intelligibility meets or exceeds the criterion value. It is of course possible that the signal in the speech channel is such that the criterion intelligibility cannot be reached even in the absence of a signal in the non-speech channel. An example of such a situation is a speech signal of very low level or with severely restricted bandwidth. If that happens a point will be reached where any further reduction of the gain applied to the non-speech channel does not affect the predicted speech intelligibility and the criterion is never met. In such a condition, the loop formed by (205,206), (207,208), and (209,210) continues indefinitely, and additional logic (not shown) may be applied to break the loop. One particularly simple example of such logic is to count the number of iterations and exit the loop once a predetermined number of iterations has been exceeded.

Continuing on in the process flow of FIG. 2, a control signal p (113) is received and multiplied with the gains (by multipliers 114 and 115). The control signal (113) will typically be an automatically derived measure of the likelihood of the signal in the speech channel being speech. Methods of automatically determining the likelihood of a signal being a speech signal are known per se and were discussed in the context of FIG. 1 (see the speech likelihood processor 130). The scaled gains are then applied to their corresponding non-speech channels (by amplifiers 116 and 117) to yield the modified signals R' and L' (118 and 119).

Figure 3:
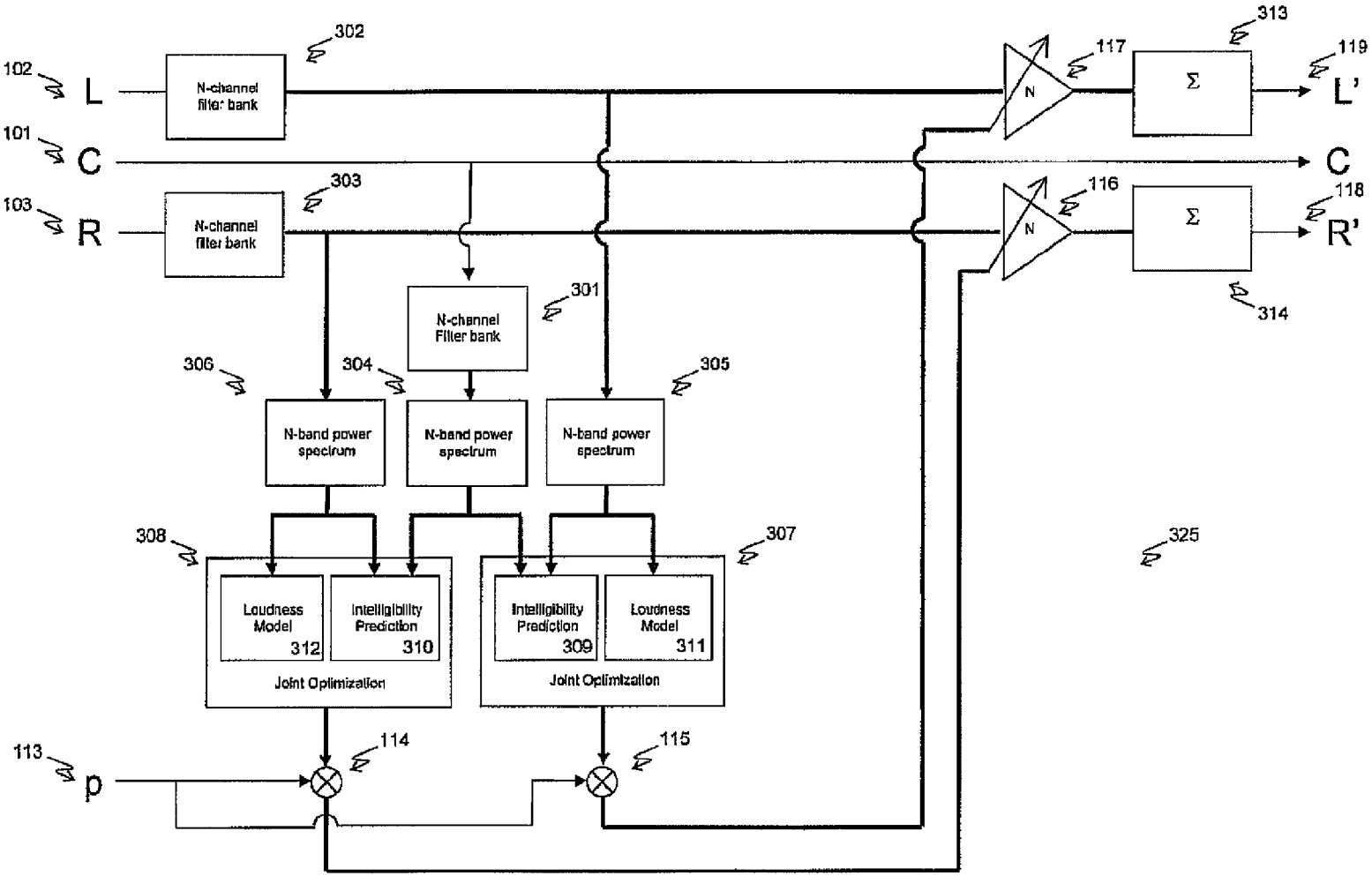
FIG. 3 illustrates a signal processor according to another embodiment of the present invention.

The principle of the third aspect of the invention is illustrated in FIG. 3. Referring now to FIG. 3, a multi-channel signal consisting of a speech channel (101) and two non-speech channels (102 and 103) is received. Each of the three signals is divided into its spectral components (by filter banks 301, 302, and 303). The spectral analysis may be achieved with a time-domain N-channel filter bank. According to one embodiment, the filter bank partitions the frequency range into ⅓-octave bands or resembles the filtering presumed to occur in the human inner ear. The fact that the signal now consists of N sub-signals is illustrated by the use of heavy lines. The process of FIG. 3 can be recognized as a side-branch process. Following the signal path, the N sub-signals that form the non-speech channels are each scaled by one member of a set of N gain values (by the amplifiers 116 and 117). The derivation of these gain values will be described later. Next, the scaled sub-signals are recombined into a single audio signal. This may be done via simple summation (by summation circuits 313 and 314). Alternatively, a synthesis filter-bank that is matched to the analysis filter bank may be used. This process results in the modified non-speech signals R' and L' (118 and 119).

Describing now the side-branch path of the process of FIG. 3, each filter bank output is made available to a corresponding bank of N power estimators (304, 305, and 306). The resulting power spectra serve as inputs to an optimization circuit (307 and 308) that has as output an N-dimensional gain vector. The optimization employs both an intelligibility prediction circuit (309 and 310) and a loudness calculation circuit (311 and 312) to find the gain vector that maximizes loudness of the non-speech channel while maintaining a predetermined level of predicted intelligibility of the speech signal. Suitable models to predict intelligibility have been discussed in connection with FIG. 2. The loudness calculation circuits 311 and 312 may implement a suitable loudness prediction model according to design choices and tradeoffs. Examples of suitable models are American National Standard ANSI S3.4-2007 "Procedure for the Computation of Loudness of Steady Sounds" and the German standard DIN 45631 "Berechnung des Lautstärkepegels and der Lautheit aus dem Geräuschspektrum".

Depending on the computational resources available and the constraints imposed, the form and complexity of the optimization circuits (307, 308) may vary greatly. According to one embodiment an iterative, multidimensional constrained optimization of N free parameters is used. Each parameter represents the gain applied to one of the frequency bands of the non-speech channel. Standard techniques, such as following the steepest gradient in the N-dimensional search space may be applied to find the maximum. In another embodiment, a computationally less demanding approach constrains the gain-vs.-frequency functions to be members of a small set of possible gain-vs.-frequency functions, such as a set of different spectral gradients or shelf filters. With this additional constraint the optimization problem can be reduced to a small number of one-dimensional optimizations. In yet another embodiment an exhaustive search is made over a very small set of possible gain functions. This latter approach might be particularly desirable in real-time applications where a constant computational load and search speed are desired.

Those skilled in the art will easily recognize additional constraints that might be imposed on the optimization according to additional embodiments of the present invention. One example is restricting the loudness of the modified non-speech channel to be not larger than the loudness before modification. Another example is imposing a limit on the gain differences between adjacent frequency bands in order to limit the potential for temporal aliasing in the reconstruction filter bank (313, 314) or to reduce the possibility for objectionable timbre modifications. Desirable constraints depend both on the technical implementation of the filter bank and on the chosen tradeoff between intelligibility improvement and timbre modification. For clarity of illustration, these constraints are omitted from FIG. 3.

Continuing on in the process flow of FIG. 3, a control signal p (113) is received and multiplied with the gains functions (by the multipliers 114 and 115). The control signal (113) will typically be an automatically derived measure of the likelihood of the signal in the speech channel being speech. Suitable methods for automatically calculating the likelihood of a signal being speech have been discussed in connection with FIG. 1 (see the speech likelihood processor 130). The scaled gain functions are then applied to their corresponding non-speech channels (by amplifiers 116 and 117), as described earlier.

Figure 4A:
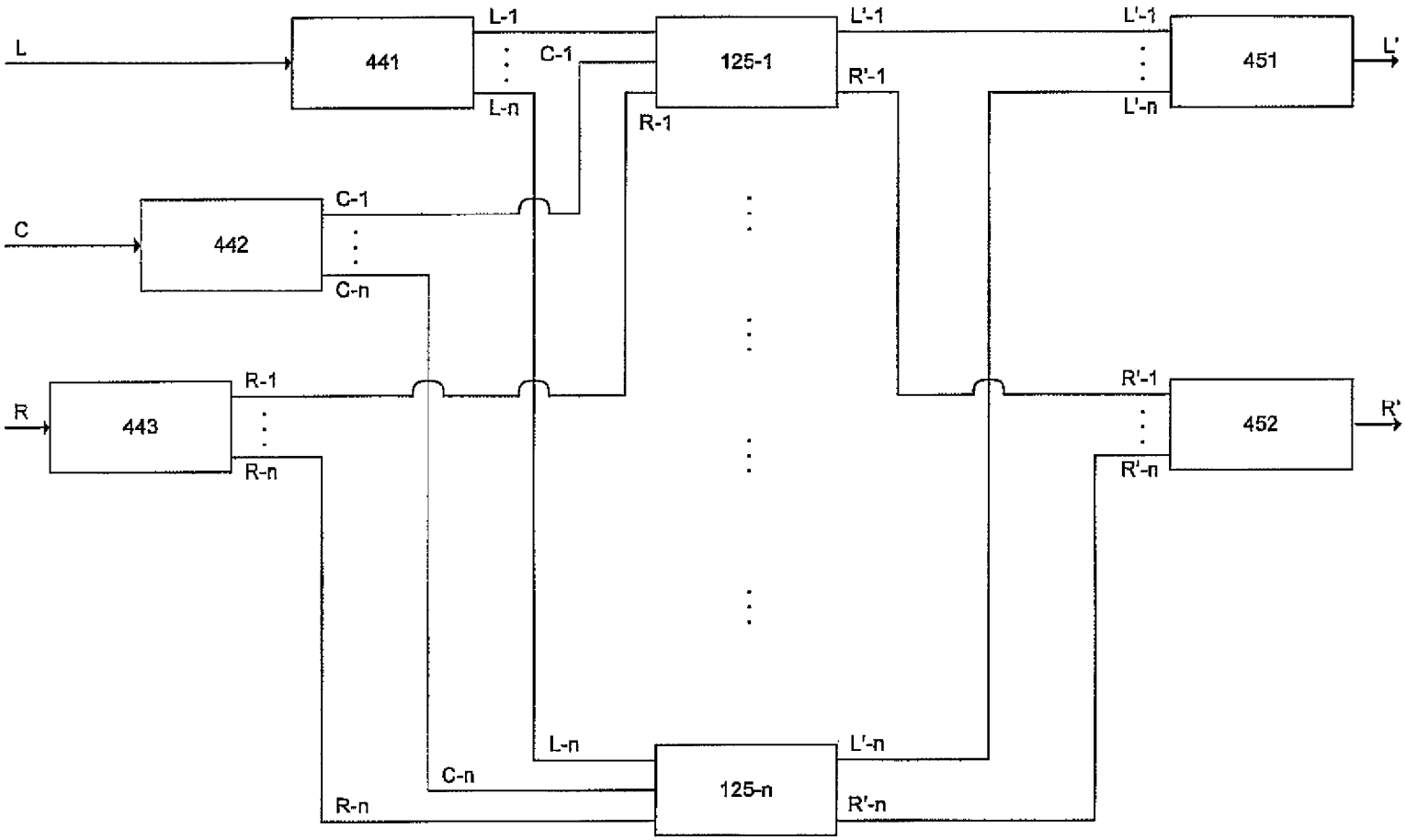
FIGS. 4A-4B are block diagrams illustrating further variations of the embodiments of FIGS. 1-3.
Figure 4B:
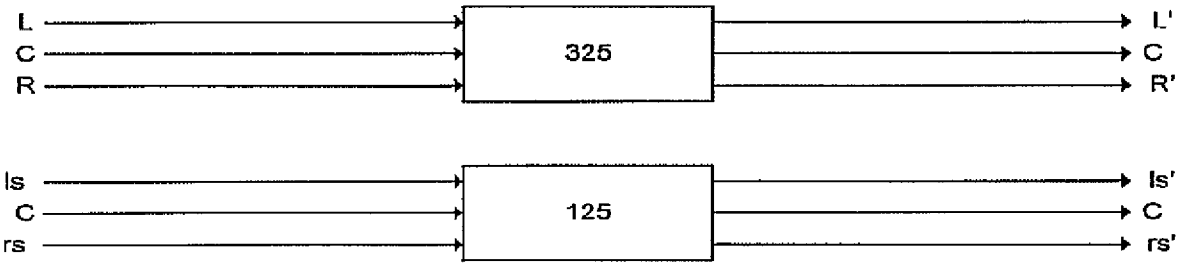

FIGS. 4A and 4B are block diagrams illustrating variations of the aspects shown in FIGS. 1-3. In addition, those skilled in the art will recognize several ways of combining the elements of the invention described in FIGS. 1 through 3.

FIG. 4A shows that the arrangement of FIG. 1 can also be applied to one or more frequency sub-bands of L, C, and R. Specifically, the signals L, C, and R may each be passed through a filter bank (441, 442 and 443), yielding three sets of n sub-bands: $\{L_1\ L_2, \ldots, L_n\}$, $\{C_1, C_2, \ldots, C_n\}$, and $\{R_1, R_2, \ldots, R_n\}$. Matching sub-bands are passed to n instances of the circuit 125 illustrated in FIG. 1, and the processed sub signals are recombined (by the summation circuits 451 and 452). A separate threshold value $\Theta_n$ can be selected for each sub band. A good choice is a set where $\Theta_n$ is proportional to the average number of speech cues carried in the corresponding frequency region; i.e., bands at the extremes of the frequency spectrum are assigned lower thresholds than bands corresponding to dominant speech frequencies. This implementation of the invention offers a very good tradeoff between computational complexity and performance.

FIG. 4B shows another variation. For example, to reduce the computational burden, a typical surround sound signal with five channels (C, L, R, ls, and rs) may be enhanced by processing the L and R signals according to the circuit 325 shown in FIG. 3, and the ls and rs signals, which are typically less powerful than the L and R signals, according to the circuit 125 shown in FIG. 1.

In the above description, the terms "speech" (or speech audio or speech channel or speech signal) and "non-speech" (or non-speech audio or non-speech channel or non-speech signal) are used. A skilled artisan will recognize that these terms are used more to differentiate from each other and less to be absolute descriptors of the content of the channels. For example, in a restaurant scene in a film, the speech channel may predominantly contain the dialogue at one table and the non-speech channels may contain the dialogue at other tables (hence, both contain "speech" as a layperson uses the term). Yet it is the dialogue at other tables that certain embodiments of the present invention are directed toward attenuating.

Implementation

The invention may be implemented in hardware or software, or a combination of both (e.g., programmable logic arrays). Unless otherwise specified, the algorithms included as part of the invention are not inherently related to any particular computer or other apparatus. In particular, various general-purpose machines may be used with programs written in accordance with the teachings herein, or it may be more convenient to construct more specialized apparatus (e.g., integrated circuits) to perform the required method steps. Thus, the invention may be implemented in one or more computer programs executing on one or more programmable computer systems each comprising at least one processor, at least one data storage system (including volatile and non-volatile memory and/or storage elements), at least one input device or port, and at least one output device or port. Program code is applied to input data to perform the functions described herein and generate output information. The output information is applied to one or more output devices, in known fashion.

Each such program may be implemented in any desired computer language (including machine, assembly, or high level procedural, logical, or object oriented programming languages) to communicate with a computer system. In any case, the language may be a compiled or interpreted language.

Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be considered to be implemented as a computer-readable storage medium, configured with a computer program, where the storage medium so configured causes a computer system to operate in a specific and predefined manner to perform the functions described herein.

The above description illustrates various embodiments of the present invention along with examples of how aspects of the present invention may be implemented. The above examples and embodiments should not be deemed to be the only embodiments, and are presented to illustrate the flexibility and advantages of the present invention as defined by the following claims. Based on the above disclosure and the following claims, other arrangements, embodiments, implementations and equivalents will be evident to those skilled in the art and may be employed without departing from the spirit and scope of the invention as defined by the claims.

What is claimed is:

1. A method of improving audibility of speech in a multi-channel audio signal, comprising:

receiving the multi-channel audio signal, wherein the multi-channel audio signal includes a left channel, a right channel, a left surround channel, a right surround channel, and a center channel, wherein the center channel contains speech audio, and wherein the left channel, the right channel, the left surround channel, and the right surround channel contain non-speech audio;

comparing a power spectrum of the left channel and a power spectrum of the center channel to generate a left attenuation factor, wherein the power spectrum of the left channel is generated by a first N-band power estimator as a first multiband power spectrum having N bands, wherein N is greater than one;

comparing a power spectrum of the right channel and the power spectrum of the center channel to generate a right attenuation factor, wherein the power spectrum of the right channel is generated by a second N-band power estimator as a second multiband power spectrum having N bands;

comparing a power level of the left surround channel and a power level of the center channel to generate a left surround attenuation factor, wherein the power level of the left surround channel is generated over the left surround channel considered as a single band;

comparing a power level of the right surround channel and the power level of the center channel to generate a right surround attenuation factor, wherein the power level of the right surround channel is generated over the right surround channel considered as a single band;

adjusting the left attenuation factor, the right attenuation factor, the left surround attenuation factor, and the right surround attenuation factor according to a speech likelihood value to generate an adjusted left attenuation factor, an adjusted right attenuation factor, an adjusted left surround attenuation factor, and an adjusted right surround attenuation factor; and attenuating the left channel using the adjusted left attenuation factor, the right channel using the adjusted right attenuation factor, the left surround channel using the adjusted left surround attenuation factor, and the right surround channel using the adjusted right surround attenuation factor.

2. The method of claim 1, further comprising:

processing the multi-channel audio signal to generate the power spectrum of the left channel, the power spectrum of the right channel, the power spectrum of the center channel, the power level of the left surround channel, the power level of the right surround channel, and the power level of the center channel.

3. The method of claim 1, further comprising:

processing the center channel to generate the speech likelihood value.

4. The method of claim 1, wherein the left channel is one of a plurality of left channels having a plurality of power levels, wherein the left attenuation factor is one of a plurality of left attenuation factors, and wherein the adjusted left attenuation factor is one of a plurality of adjusted left attenuation factors, further comprising:

comparing the power level of the center channel and the plurality of power levels of the plurality of left channels to generate the plurality of left attenuation factors;

adjusting the plurality of left attenuation factors according to the speech likelihood value to generate the plurality of adjusted left attenuation factors; and attenuating the plurality of left channels using the plurality of adjusted left attenuation factors.

5. The method of claim 1, wherein the left channel is one of a plurality of left channels, wherein the right channel is one of a plurality of right channels, wherein the left attenuation factor is one of a plurality of left attenuation factors, wherein the right attenuation factor is one of a plurality of right attenuation factors, wherein the adjusted left attenuation factor is one of a plurality of adjusted left attenuation factors, and wherein the adjusted right attenuation factor is one of a plurality of adjusted right attenuation factors, further comprising:

comparing the power spectrum of the center channel and a plurality of power spectra of the plurality of left channels to generate the plurality of left attenuation factors;

comparing the power spectrum of the center channel and a plurality of power spectra of the plurality of right channels to generate the plurality of right attenuation factors;

adjusting the plurality of left attenuation factors according to the speech likelihood value to generate the plurality of adjusted left attenuation factors;

adjusting the plurality of right attenuation factors according to the speech likelihood value to generate the plurality of adjusted right attenuation factors;

attenuating the plurality of left channels using the plurality of adjusted left attenuation factors; and attenuating the plurality of right channels using the plurality of adjusted right attenuation factors.

6. The method of claim 1, wherein comparing the power level of the left surround channel and the power level of the center channel comprises:

determining a distance between the power level of the left surround channel and the power level of the center channel; and calculating the left surround attenuation factor based on the distance and a minimum distance.

7. The method of claim 6, wherein the distance is a difference between the power level of the left surround channel and the power level of the center channel.

8. The method of claim 6, wherein the distance is a ratio between the power level of the left surround channel and the power level of the center channel.

9. The method of claim 1, wherein comparing the power spectrum of the left channel and the power spectrum of the center channel comprises:

performing intelligibility prediction based on the power spectrum of the center channel and the power spectrum of the left channel to generate a predicted intelligibility;

adjusting a gain applied to the power spectrum of the left channel until the predicted intelligibility meets a criterion; and using the gain, having been adjusted, as the left attenuation factor once the predicted intelligibility meets the criterion.

10. The method of claim 1, wherein comparing the power spectrum of the left channel and the power spectrum of the center channel comprises:

performing intelligibility prediction based on the power spectrum of the center channel and the power spectrum of the left channel to generate a predicted intelligibility;

performing loudness calculation based on the power spectrum of the left channel to generate a calculated loudness;

adjusting a plurality of gains applied respectively to each band of the power spectrum of the left channel until the predicted intelligibility meets an intelligibility criterion and the calculated loudness meets a loudness criterion; and using the plurality of gains, having been adjusted, as the left attenuation factor for each band respectively once the predicted intelligibility meets the intelligibility criterion and the calculated loudness meets the loudness criterion.

11. An apparatus including a circuit for improving audibility of speech in a multi-channel audio signal, comprising:

a circuit that is configured to receive the multi-channel audio signal, wherein the multi-channel audio signal includes a left channel, a right channel, a left surround channel, a right surround channel, and a center channel, wherein the center channel contains speech audio, and wherein the left channel, the right channel, the left surround channel, and the right surround channel contain non-speech audio;

a first comparison circuit that is configured to compare a power spectrum of the left channel and a power spectrum of the center channel to generate a left attenuation factor, and to compare a power spectrum of the right channel and the power spectrum of the center channel to generate a right attenuation factor, wherein the power spectrum of the left channel is generated by a first N-band power estimator as a first multiband power spectrum having N bands, and wherein the power spectrum of the right channel is generated by a second N-band power estimator as a second multiband power spectrum having N bands, where N is greater than one;

a second comparison circuit that is configured to compare a power level of the left surround channel and a power level of the center channel to generate a left surround attenuation factor, and to compare a power level of the right surround channel and the power level of the center channel to generate a right surround attenuation factor, wherein the power level of the left surround channel is generated over the left surround channel considered as a single band, and wherein the power level of the right surround channel is generated over the right surround channel considered as a single band;

a first multiplier that is configured to adjust the left attenuation factor according to a speech likelihood value to generate an adjusted left attenuation factor;

a second multiplier that is configured to adjust the right attenuation factor according to the speech likelihood value to generate an adjusted right attenuation factor;

a third multiplier that is configured to adjust the left surround attenuation factor according to the speech likelihood value to generate an adjusted left surround attenuation factor;

a fourth multiplier that is configured to adjust the right surround attenuation factor according to the speech likelihood value to generate an adjusted right surround attenuation factor;

a first amplifier that is configured to attenuate the left channel using the adjusted left attenuation factor;

a second amplifier that is configured to attenuate the right channel using the adjusted right attenuation factor;

a third amplifier that is configured to attenuate the left surround channel using the adjusted left surround attenuation factor; and a fourth amplifier that is configured to attenuate the right surround channel using the adjusted right surround attenuation factor.

12. The apparatus of claim 11, wherein the second comparison circuit comprises:

a first adder that is configured to subtract the power level of the center channel from the power level of the left surround channel to generate a power level difference;

a second adder that is configured to add the power level difference and a threshold value to generate a margin; and a limiter circuit that is configured to calculate the left attenuation factor as a greater one of the margin and zero.

13. The apparatus of claim 11, wherein the first comparison circuit comprises:

an intelligibility prediction circuit that is configured to perform intelligibility prediction based on the power spectrum of the center channel and the power spectrum of the left channel to generate a predicted intelligibility;

a gain adjustment circuit that is configured to adjust a gain applied to the power spectrum of the left channel until the predicted intelligibility meets a criterion; and a gain selection circuit that is configured to select the gain, having been adjusted, as the left attenuation factor once the predicted intelligibility meets the criterion.

14. The apparatus of claim 11, wherein the first comparison circuit comprises:

an intelligibility prediction circuit that is configured to perform intelligibility prediction based on the power spectrum of the center channel and the power spectrum of the left channel to generate a predicted intelligibility;

a loudness calculation circuit that is configured to perform loudness calculation based on the power spectrum of the left channel to generate a calculated loudness; and an optimization circuit that is configured to adjust a plurality of gains applied respectively to each band of the power spectrum of the left channel until the predicted intelligibility meets an intelligibility criterion and the calculated loudness meets a loudness criterion, and that uses the plurality of gains, having been adjusted, as the left attenuation factor for each band respectively once the predicted intelligibility meets the intelligibility criterion and the calculated loudness meets the loudness criterion.

15. The apparatus of claim 11, further comprising:

a first power estimator that is configured to calculate the power level of the center channel; and a second power estimator that is configured to calculate the power level of the left surround channel.

16. The apparatus of claim 11, further comprising:

a first power spectral density calculator that is configured to calculate the power spectrum of the center channel; and a second power spectral density calculator that is configured to calculate the power spectrum of the left channel.

17. The apparatus of claim 11, further comprising:

a first filter bank that is configured to divide the center channel into a first plurality of spectral components;

a first power estimator bank that is configured to calculate the power spectrum of the center channel from the first plurality of spectral components;

a second filter bank that is configured to divide the left channel into a second plurality of spectral components; and a second power estimator bank that is configured to calculate the power spectrum of the left channel from the second plurality of spectral components.

18. The apparatus of claim 11, further comprising:

a speech determination processor that is configured to process the center channel to generate the speech likelihood value.

19. A computer program embodied in tangible non-transitory recording medium for improving audibility of speech in a multi-channel audio signal, the computer program controlling a device to execute processing comprising:

receiving the multi-channel audio signal, wherein the multi-channel audio signal includes a left channel, a right channel, a left surround channel, a right surround channel, and a center channel, wherein the center channel contains speech audio, and wherein the left channel, the right channel, the left surround channel, and the right surround channel contain non-speech audio;

comparing a power spectrum of the left channel and a power spectrum of the center channel to generate a left attenuation factor, wherein the power spectrum of the left channel is generated by a first N-band power estimator as a first multiband power spectrum having N bands, wherein N is greater than one;

comparing a power spectrum of the right channel and the power spectrum of the center channel to generate a right attenuation factor, wherein the power spectrum of the right channel is generated by a second N-band power estimator as a second multiband power spectrum having N bands;

comparing a power level of the left surround channel and a power level of the center channel to generate a left surround attenuation factor, wherein the power level of the left surround channel is generated over the left surround channel considered as a single band;

comparing a power level of the right surround channel and the power level of the center channel to generate a right surround attenuation factor, wherein the power level of the right surround channel is generated over the right surround channel considered as a single band;

adjusting the left attenuation factor, the right attenuation factor, the left surround attenuation factor, and the right surround attenuation factor according to a speech likelihood value to generate an adjusted left attenuation factor, an adjusted right attenuation factor, an adjusted left surround attenuation factor, and an adjusted right surround attenuation factor; and attenuating the left channel using the adjusted left attenuation factor, the right channel using the adjusted right attenuation factor, the left surround channel using the adjusted left surround attenuation factor, and the right surround channel using the adjusted right surround attenuation factor.

20. An apparatus for improving audibility of speech in a multi-channel audio signal, comprising:

means for receiving the multi-channel audio signal, wherein the multi-channel audio signal includes a left channel, a right channel, a left surround channel, a right surround channel, and a center channel, wherein the center channel contains speech audio, and wherein the left channel, the right channel, the left surround channel, and the right surround channel contain non-speech audio;

first means for comparing a power spectrum of the left channel and a power spectrum of the center channel to generate a left attenuation factor, and for comparing a power spectrum of the right channel and the power spectrum of the center channel to generate a right attenuation factor, wherein the power spectrum of the left channel is generated by a first N-band power estimator as a first multiband power spectrum having N bands, and wherein the power spectrum of the right channel is generated by a second N-band power estimator as a second multiband power spectrum having N bands, where N is greater than one;

second means for comparing a power level of the left surround channel and a power level of the center channel to generate a left surround attenuation factor, and for comparing a power level of the right surround channel and the power level of the center channel to generate a right surround attenuation factor, wherein the power level of the left surround channel is generated over the left surround channel considered as a single band, and wherein the power level of the right surround channel is generated over the right surround channel considered as a single band;

means for adjusting the left attenuation factor, the right attenuation factor, the left surround attenuation factor, and the right surround attenuation factor according to a speech likelihood value to generate an adjusted left attenuation factor, an adjusted right attenuation factor, an adjusted left surround attenuation factor, and an adjusted right surround attenuation factor; and means for attenuating the left channel using the adjusted left attenuation factor, for attenuating the right channel using the adjusted right attenuation factor, for attenuating the left surround channel using the adjusted left surround attenuation factor, and for attenuating the right surround channel using the adjusted right surround attenuation factor.

21. The apparatus of claim 20, wherein the second means for comparing comprises:

means for subtracting the power level of the center channel from the power level of the left surround channel to generate a power level difference; and means for calculating the left attenuation factor based on the power level difference and a threshold difference.

22. The apparatus of claim 20, wherein the first means for comparing comprises:

means for performing intelligibility prediction based on the power spectrum of the center channel and the power spectrum of the left channel to generate a predicted intelligibility;

means for adjusting a gain applied to the power spectrum of the left channel until the predicted intelligibility meets a criterion; and means for using the gain, having been adjusted, as the left attenuation factor once the predicted intelligibility meets the criterion.

23. The apparatus of claim 20, wherein the first means for comparing comprises:

means for performing intelligibility prediction based on the power spectrum of the center channel and the power spectrum of the left channel to generate a predicted intelligibility;

means for performing loudness calculation based on the power spectrum of the left channel to generate a calculated loudness;

means for adjusting a plurality of gains applied respectively to each band of the power spectrum of the left channel until the predicted intelligibility meets an intelligibility criterion and the calculated loudness meets a loudness criterion; and means for using the plurality of gains, having been adjusted, as the left attenuation factor for each band respectively once the predicted intelligibility meets the intelligibility criterion and the calculated loudness meets the loudness criterion.

* * * * *